United States Patent [19]

Dalbo

[11] Patent Number: 4,832,240

[45] Date of Patent: May 23, 1989

[54] NEEDLE THREADER WITH NEEDLE-HOLDING NOTCH

[75] Inventor: Emil J. Dalbo, Tucker, Ga.

[73] Assignee: Dal-Craft, Inc., Tucker, Ga.

[21] Appl. No.: 153,000

[22] Filed: Feb. 8, 1988

[51] Int. Cl.[4] ..... D05B 87/00

[52] U.S. Cl. ..... 223/99

[58] Field of Search ..... 223/109 R, 99; 206/380

[56] References Cited

U.S. PATENT DOCUMENTS

| | | | |
|---|---|---|---|
| 1,288,322 | 12/1918 | Webb | 223/99 |
| 3,838,801 | 10/1974 | David | 223/99 |
| 3,840,160 | 10/1974 | Pearce | 223/99 |

FOREIGN PATENT DOCUMENTS

| | | | |
|---|---|---|---|
| 21543 | 5/1900 | Fed. Rep. of Germany | 223/99 |
| 135346 | 8/1901 | Fed. Rep. of Germany | 223/99 |

*Primary Examiner*—Andrew M. Falik

*Attorney, Agent, or Firm*—James B. Middleton

[57] ABSTRACT

A needle threader for needlecraft needles has a notch to retain a needle in position on the threader while thread is passed through the eye in the needle threader. The notch may be used in conjunction with shoulders utilized as stops for the needle, or may be used with the more conventional threader. The notch for retaining the needle allows easier threading because the threader with the needle can be held with one hand while the thread is manipulated with the other.

3 Claims, 1 Drawing Sheet

Fig_1
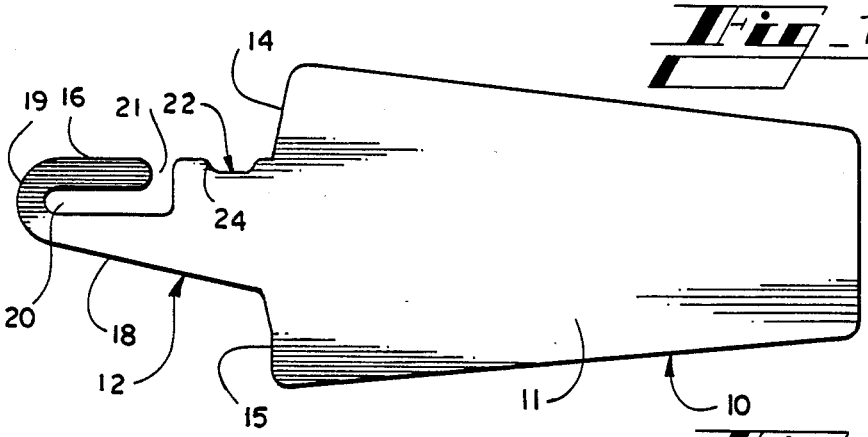
Fig_2
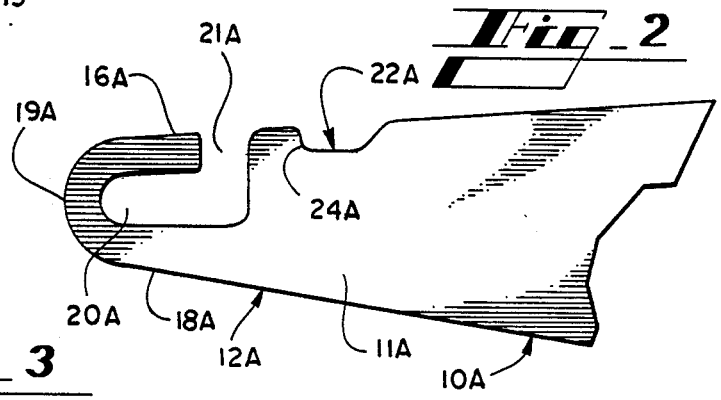
Fig_3
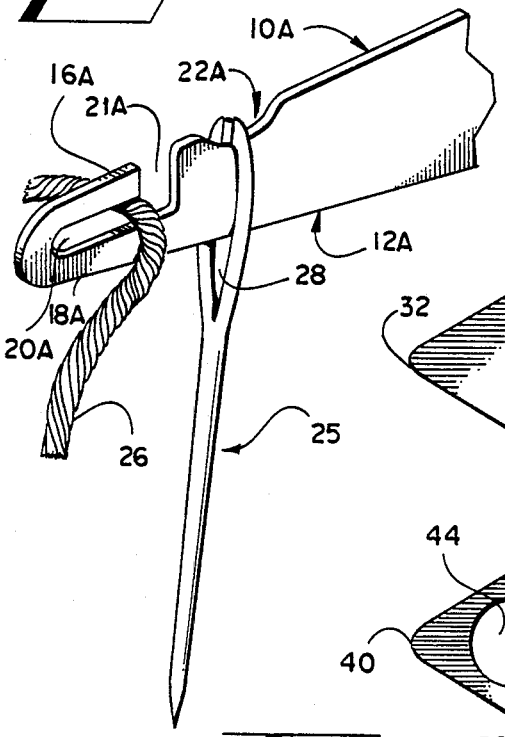
Fig_4
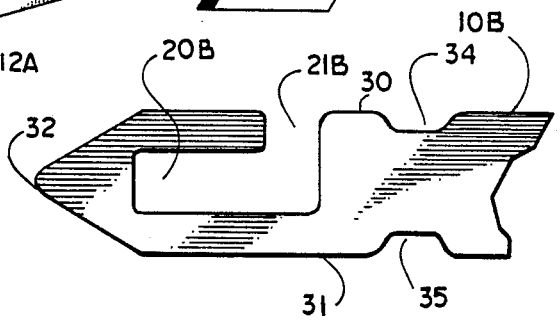
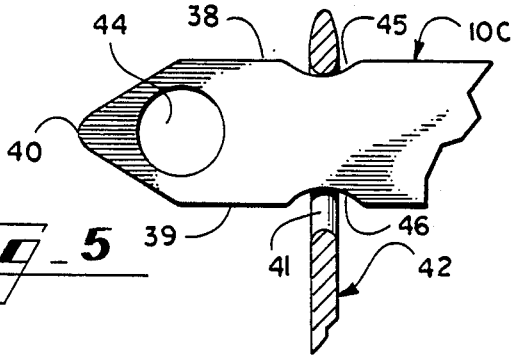
Fig_5

NEEDLE THREADER WITH NEEDLE-HOLDING NOTCH

CROSS-REFERENCE TO RELATED APPLICATION

This is a continuation-in-part of the application by the same inventor titled "Needle Case with Needle Threader for Needlecraft", filed Jan. 11, 1988, Ser. No. 142,660.

INFORMATION DISCLOSURE STATEMENT

Needle threaders have long been known in the art, and needle threaders formed of a generally flat sheet material for threading needlecraft needles have also long been known in the art. The most common needle threader for needlecraft needles utilizes a flat material formed into a narrow strip, and sometimes in a tapering shape that terminates in a rounded or pointed end. The rounded end conventionally includes some form of eye for receiving thread or yarn therethrough. The technique is, then, to pass the type through the eye of the needle, and to hold the needle threader and the needle while passing a piece of yarn through the eye of the needle threader. Once the yarn is through the eye of the needle threader, the needle threader is retracted from the eye of the needle to pull the yarn through the eye of the needle.

While the above described needle threaders will generally perform the intended task, use of such devices can be extremely difficult because one must hold the needle threader, hold the needle on the needle threader, and simultaneously pass a piece of yarn through the eye in the needle threader. This is necessary because, if the upper edge of the needle threader is not held completely horizontally, the needle will slide to the end of the threader and interfere with the threading of the needle. Therefore, while the basic needle threader is satisfactory, there is need for improvement to render the device easier to use.

SUMMARY OF THE INVNTION

This invention relates generally to needle threaders, and is more particularly concerned with a needle threader having means for retaining a needle in place on the needle threader while yarn is engaged with the needle threader.

The present invention utilizes a generally conventional needle threader for needlecraft needles and the like, such needle threaders normally including relatively flat, or sheet, material formed into a normal strip of uniform width, or tapering, the end of the strip being pointed. The significant feature of the present invention is the provision of a needle holding means rearwardly of the eye of the needle threader. While it is contemplated that the needle threader will be of the type disclosed in the above identified co-pending application, other existing forms of needle threaders can also be utilized in conjunction with the present invention. For a complete understanding, the entire disclosure in the above identified co-pending application is incorporated herein by reference.

In the preferred embodiment of the invention, the needle holding means comprises a notch provided in one edge of the needle threader. The needle holding means may be in both edges of a needle holder, especially if the threader is of the type that uses a hole for the eye of the threader, since there is no "top" or "bottom" of such threaders. For a needle threader having an opening into the eye, it may be desirable to use only one needle holding notch, and this may be placed on the edge considered to be the "top". It will of course be understood by those skilled in the art that a small protuberance from the edge of the needle threader will also hold the needle, and is within the scope of the present invention.

BRIEF DESCRIPTION OF THE DRAWINGS

These and other features and advantages of the present invention will become apparent from consideration of the following specification when taken in conjunction with the accompanying drawings in which:

FIG. 1 is a front elevational view of a needle threader made in accordance with the present invention;

FIG. 2 is a fragmentary view similar to FIG. 1 showing a slightly modified from of the invention;

FIG. 3 is a perspective view of the device shown in FIG. 2, the needle threader being shown in conjunction with a yarn and a needle; and, FIGS. 4 and 5 are views similar to FIG. 3 showing additional modified forms of the invention.

DETAILED DESCRIPTION OF THE EMBODIMENTS

Referring now more particularly to the drawings, and to that embodiment of the invention shown in FIG. 1, it will be seen that the needle threader is generally indicated at 10 and includes a body portion 11 having a needle threading portion 12 extending from the left hand end as shown in FIG. 1. Between the body 11 and the needle threading portion 12, there are shoulders 14 and 15. These shoulders 14 and 15 are disclosed and explained in detail in the above identified co-pending application, and the description will not be repeated.

The needle threading portion 12 has upper and lower edges 16 and 18 which generally converge towards the rounded end 19 so that the needle threading portion 12 is generally tapered from a minimum dimension at 19 to a maximum dimension at the shoulders 14 and 15.

There is an eye 20 in the needle threading portion 12 for receiving a yarn, and an entrance opening 21 provides easy access to the eye 20.

As is discussed in the above identified co-pending application, with the structure thus far described, the rounded end 19 can be passed through the eye of a needle until the shoulders 14 and 15 engage the needle. At this point, a piece of yarn can be passed through the opening 21 and into the eye 20 of the needle threader 10. With the yarn in place within the eye 20, the needle will be removed from the needle threading portion 12, and the needle threading portion 12 will pull the yarn through the eye of the needle.

In the co-pending application, it will be remembered that the needle must be simply held against the shoulders 14 and 15. Thus, one must hold the needle threader 10 and the needle in one hand, and hold the yarn in the other hand, in order to accomplish the threading of a needle. The important feature of the present invention is therefore the needle holding means indicated at 22.

The needle holding means 22 is here indicated as a notch formed in the edge 16 of the needle threading portion 12. Specifically, the notch 22 has rounded shoulders 24 so the needle can easily be removed from the notch, though the notch 22 is sufficiently deep that the needle will be easily retained therein. Through use of the needle retaining notch 22 it will be understood that a needle can be received over the needle threading portion 12, and the needle will fall easily into the notch 22. One can then hold the needle threader 10 with one hand, and the needle will stay in position. With the needle in position, a piece of yarn can be slipped into the eye 20 through the opening 21. After the yarn is in place, one can grab the needle with one hand and the needle threader 10 with the other hand and complete the threading.

Looking at FIG. 2 of the drawings, it will be seen that the needle threader is designated at 10A. The only difference between the needle threader 10 shown in FIG. 1 and needle threading portion 12A shown in FIG. 2 is that the needle threader 10A does not have the shoulders 14 and 15. Since other aspects of the needle threader are the same, the needle threader shown in FIG. 2 carries the same reference numerals but with an A suffix. The operation is also the same, and will not be repeated. It should be pointed out only that the needle threader shown in FIG. 2 of the drawings does not have the shoulders 14 and 15 so that one must simply place the needle threader 10A through the eye of the needle to the desired extent. While one would normally have to hold both the needle and the needle threader 10A, through the use of the notch 22A the needle can be retained in position in the notch 22A while the person holds the needle threader 10A, and a piece of yarn can be passed through the opening 21A and into the eye 20A of the needle threading portion 12A.

Looking next at FIG. 3 of the drawings, it will be seen that the needle threader shown in FIG. 3 is the needle threader 10A which is shown in FIG. 2 of the drawings. In FIG. 3 the needle threader 10A is shown with a needle 25 retained in the notch 22A, and a piece of yarn 26 passing through the opening 21A and into the eye 20A. Therefore, FIG. 3 illustrates the simplicity of the present arrangement whereby one can place the needle threading portion 12A through the eye 28 of the needle 25, and the needle 25 can be placed within the notch 22A. At this point, one can grasp the needle threader 10A without great concern for the position of the needle 25. Next, the other hand can be used to select a yarn 26, and pass the yarn 26 through the opening 21A and into the eye 20A. With the yarn 26 in place, the needle 25 can be grasped with one hand while the needle threader 10A is grasped with the other hand. Motion of the needle threader 10A to remove the needle threading portion 12A from the eye 28 of the needle 25 will then pull the yarn 26 through the eye 28 to thread the needle.

FIG. 4 of the drawings shows a further modified form of needle threader designated at 10B, the needle threader portion having upper and lower edges 30 and 31 parallel to each other. The tip 32 of the threader is also substantially pointed rather than simply rounded. It will of course be recognized that the tip 32 needs to be so formed as to facilitate passage of the needle threader through the eye of a needle. The rounded end as shown in FIGS. 1–3 is frequently used and works quite well, and a pointed end as shown in FIG. 4 will achieve the same result.

The threader 10B defines an eye 20B and an opening 21B into the eye 20B. The body 11B defines notches 34 in the upper edge 30 and 35 in the lower edge 31. With the needle holding notches 34 and 35 in both upper and lower edges 30 and 31, it will be understood that a needle can be retained in a notch regardless of the manner of use of the needle threader. It will of course be realized that one person may consider the edge 30 to be the "upper" edge, and hold the needle threader 10B as shown in the drawings. Another person may consider the edge 31 to be the "upper" edge, and invert the device for use. Thus, the terms "upper" and "lower" must be taken as relative, though the terms are used herein to designate the respective edges as shown in the drawings. No limitation should be understood by the use of such terms.

Looking finally at FIG. 5 of the drawings, the needle threader is designated at 10C and has parallel upper and lower edges 38 and 39. The tip 40 is substantially pointed for being received through the eye 41 of a needle 42. The eye 44 in the needle threader 10C is an opening defined in the body of the material, without a threading opening as in the previously described embodiments of the present invention, and there are needle holding notches 45 and 46 defined in the upper and lower edges 38 and 39 respectfully.

In the needle threader of the type shown in FIGS. 4 and 5, it will be understood that the height, or width between upper and lower edges is usually just sufficient to be received within the eye of a needle to be threaded. The dimensional relationship is shown in FIG. 5 which includes a needle 42 received within the needle holding notch 45. It will further be noticed with respect to FIG. 5 that there will be no difference in the threader if the device is inverted from the position shown in the drawings.

It will therefore be seen that the present invention provides a very simple, yet convenient holding means in combination with a needle threader. Through the use of the present invention, the needle can be conveniently retained in place without requiring extreme manual dexterity. Also, while a notch has been illustrated as the needle holding means, it will be understood that a small protuberance or other well known means might also be used to hold the needle in the selected position.

It will therefore be understood by those skilled in art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A needle threader for threading needlecraft needles, said threader comprising a body and a threading portion extending from said body, said threading portion having a maximum width to be received through the eye of a needle, a tip at the extending end of said threading portion for allowing said threading portion to be inserted into the eye of a needle, and an eye in said threading portion for receiving a yarn therethrough, said threading portion having an upper edge and a lower edge, and including needle retaining means on at least one of said edges between said body and said eye in said threader portion, said needle retaining means comprising a notch defined in said edge, said notch having sufficient width to receive a needle therein and sufficient depth to restrain a needle from inadvertent motion along said threading portion during normal usage of said needle threader.

2. A needle threader for threading needlecraft needles, said threader comprising a body and a threading portion extending from said body, said threading portion having a maximum width to be received through the eye of a needle, a tip at the extending end of said threading portion for allowing said threading portion to be inserted into the eye of a needle, and an eye in said threading portion for receiving a yarn therethrough, said threading portion having an upper edge and a lower edge, and including needle retaining means on at least one of said edges between said body and said eye in said threader portion, said threading portion further defining an opening from said upper edge into said eye in said threading portion, said needle retaining means being located adjacent to said opening, said needle retaining means comprising a notch defined in said edge, said notch having sufficient width to receive a needle therein, and sufficient depth to restrain a needle from inadvertent motion along said threading portion during normal usage of said threader.

3. A needle threader as claimed in claim 2, and further including a pair of shoulders on said body, said shoulders defining the inner end of said threading portion, said shoulders being so dimensioned that the eye of a needle cannot receive said shoulders, said notch being located between said eye in said threading portion and said shoulders.

* * * * *